United States Patent [19]

Seguin

[11] 4,443,658

[45] Apr. 17, 1984

[54] REMOTE CONTROL CABLE FOR TRANSMITTING ELECTRICAL SIGNALS AND PROCESS AND APPARATUS FOR PRODUCTION THEREOF

[76] Inventor: Pierre Seguin, Chavanoz, France

[21] Appl. No.: 397,245

[22] Filed: Jul. 12, 1982

[51] Int. Cl.[3] ..... H01B 7/04

[52] U.S. Cl. ..... 174/113 C; 156/56; 156/500; 174/131 A; 425/110

[58] Field of Search ..... 174/113 R, 113 C, 131 A, 174/131 B

[56] References Cited

U.S. PATENT DOCUMENTS

| | | | |
|---|---|---|---|
| 2,584,027 | 1/1952 | Kendrick | 174/113 C |
| 3,324,233 | 6/1967 | Bryant | 174/113 R |
| 3,472,947 | 10/1969 | Seguin | 174/113 C |
| 3,553,349 | 1/1971 | Heinzmann | 174/113 R |
| 4,010,619 | 3/1977 | Hightower et al. | 174/113 R |
| 4,084,065 | 4/1978 | Swenson | 174/113 R |
| 4,097,686 | 6/1978 | Gladenbeck et al. | 174/113 C |
| 4,135,056 | 1/1979 | Seguin | 174/113 C |
| 4,197,423 | 4/1980 | Fusen | 174/113 R |

FOREIGN PATENT DOCUMENTS

| | | | |
|---|---|---|---|
| 1109228 | 6/1961 | Fed. Rep. of Germany | 174/113 C |
| 1477500 | 4/1967 | France . | |
| 90970 | 3/1968 | France . | |

*Primary Examiner*—J. V. Truhe

*Assistant Examiner*—Morris H. Nimmo

*Attorney, Agent, or Firm*—Sherman & Shalloway

[57] ABSTRACT

A remote control cable has a central core formed from two conducting wires separated over their entire length by a textile element with which the wires are in intimate contact, preferably slightly embedded therein, the whole being covered by a coating of a thermofusible material. The central core is strengthened by filamentary reinforcing elements arranged in parallel to the conducting wires and by at least one, preferably two, layers of braiding over the reinforcing elements. The central textile element maintains the conducting wires separated and parallel to each other during manufacture and under conditions of use. The cables may be used for transmitting signals, e.g. electrical pulses, to remote objects, for example, to transmit directions for controlling objects moving at high speeds, e.g. up to 300 m/second or higher and over distances up to 4000 meters or more. The central core is produced by pulling the conducting wires and central textile element through a convergent wire guide inlet of a calibrating die, after the assembly is coated with a molten, thermofusible coating material, under conditions such that the conducting wires are on either side of the central textile element and the wires are in rubbing contact with the dies so that they are forced into and produce a deformation of the textile element and become slightly embedded therein as the assembly is pulled through the die.

14 Claims, 6 Drawing Figures

Fig. 1.
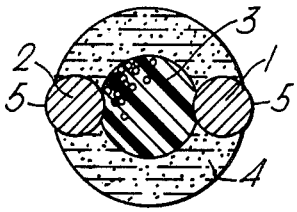
Fig. 2.
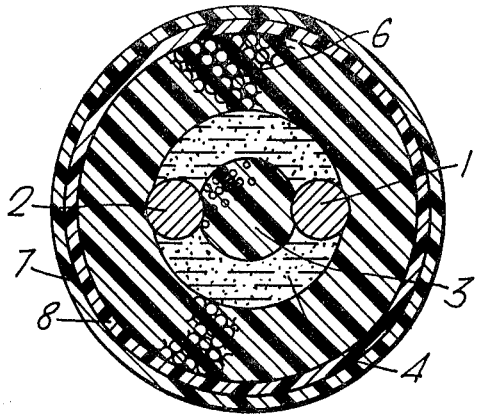
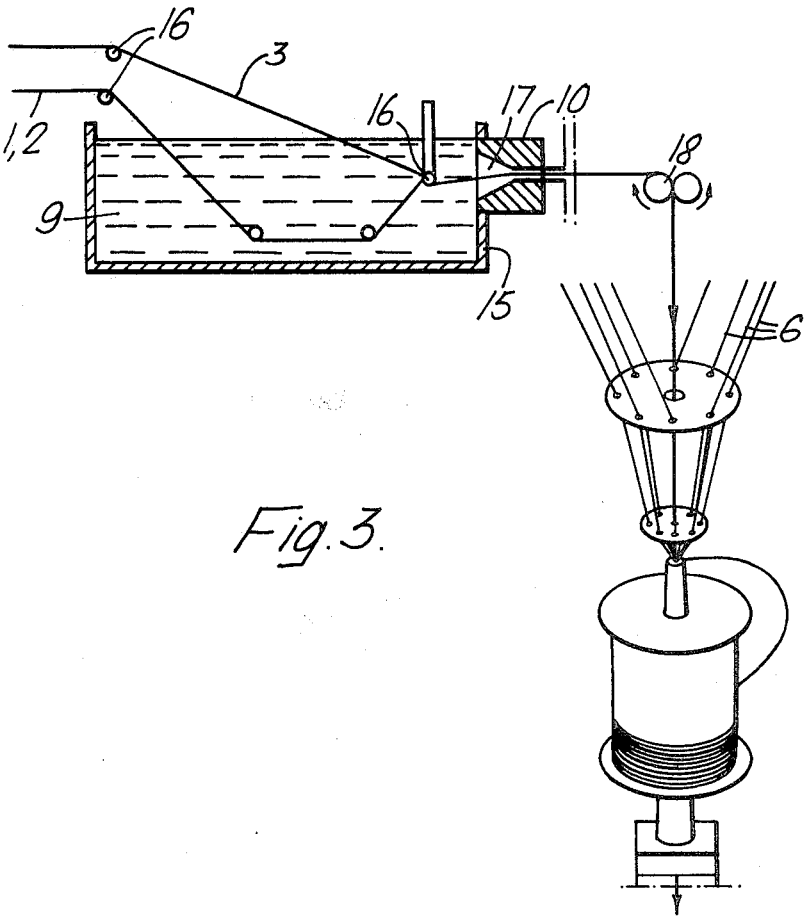
Fig. 3.

Fig. 4.
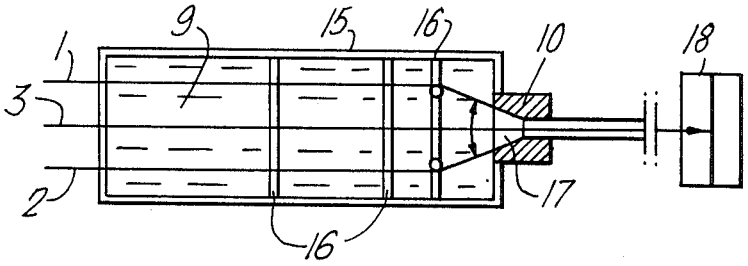
Fig. 5.
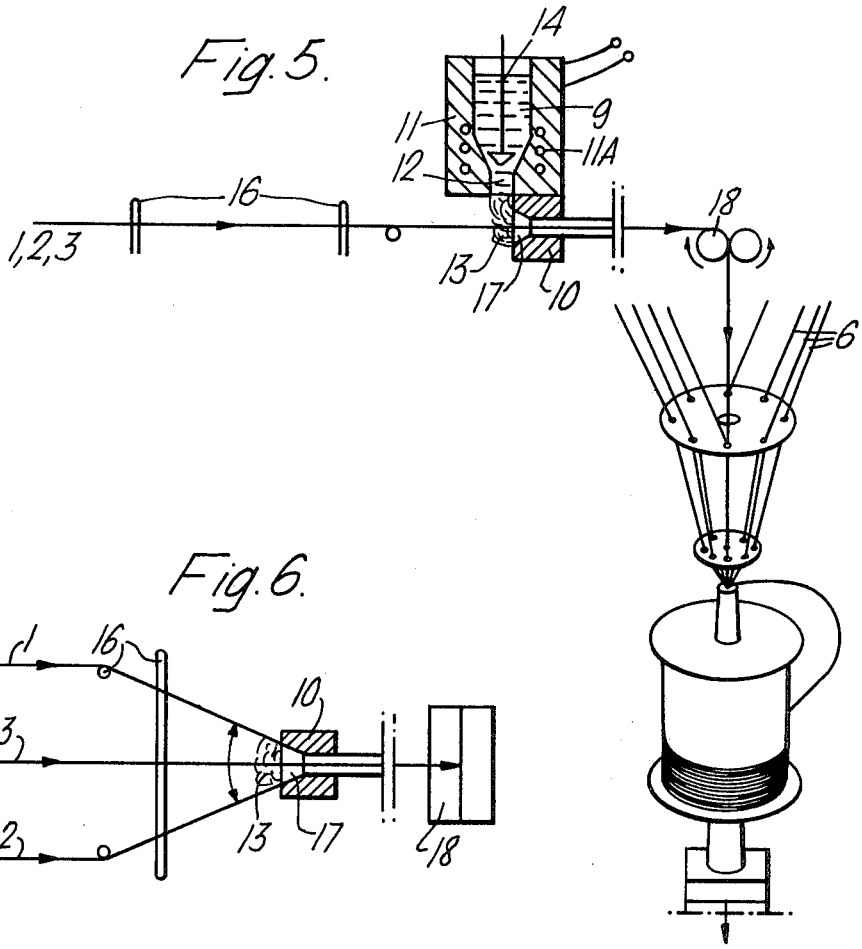
Fig. 6.

REMOTE CONTROL CABLE FOR TRANSMITTING ELECTRICAL SIGNALS AND PROCESS AND APPARATUS FOR PRODUCTION THEREOF

The present invention relates to a remote control cable, which may for example be used for the transmission of the directions for controlling bodies moving at high speed. Such a cable is advantageously light, of small cross-section, of high tensile strength, virtually inextensible, flexible and leaktight.

The cable is normally used for guiding a moving body by means of signals in the form of electrical pulses, a determined length of the cable being stored at the rear of the moving body and unwinding progressively as it moves.

The invention also relates to a new process and apparatus for the production of a cable of this type.

Numerous documents describe conducting cables which are capable of transmitting directions to a moving body. Amongst these documents, there may be mentioned French Pat. No. 1,477,500 and its two Patents of Addition Nos. 90,970 and 93,154.

Thus, French Pat. No. 1,477,500 describes an inextensible conducting cable which is composed of a core of glass filaments containing at least two separate conductors, in practice located along the longitudinal axis of the cable, the core being surrounded by a layer of braiding and the whole being covered by at least one thin coating layer.

According to Addition No. 90,970, in order to ensure that the conductors are kept separate, they are arranged symmetrically relative to a glued core of glass filaments, and they are bonded to the latter by heat sealing. Other glass filaments, for reinforcement, are arranged parallel to the assembly of core and conductors and, as in the main patent, the whole is surrounded by a braiding and an external coating. Preferably, the conducting wires are slightly inset into the central core.

Addition No. 93,154 relates to improvements made to the abovementioned conducting cables, these improvements mainly concerning the nature and the production of the braiding and the external coating of the said cable.

The conducting cables described in the abovementioned documents have very great qualities, in particular as regards their thinness, their strength and especially their electrical properties, in particular their time constant.

However, the positioning of the conducting wires symmetrically relative to the core is rather difficult to carry out and, during manufacture and/or in the course of operation, they can move slightly, which detracts from good transmission of the signals. To overcome these disadvantages, it has been proposed, in particular in French Pat. No. 2,005,693, to hold and separate the conducting wires of a cable of the type described above by gluing them together in parallel, using the same lacquer as that used to insulate each of the wires. Although this solution is attractive in theory, it must be recognised that it is difficult to carry out from a practical point of view and that it has a certain number of disadvantages. In fact, with this method, it is virtually impossible to have a correct connection between the two conductors over their entire length, because the gluing is carried out over a very small part and the conductors can tend to move away from one another during use. Finally, the separation between the two conductors is determined by the thickness of the insulating layer which surrounds each conductor, which therefore means that they must be covered with a relatively thick layer of insulator if it is desired to have a sufficient separation between them.

Again with the purpose of improving the characteristics of the product, a new cable was proposed in French Pat. No. 2,341,187. This is a cable comprising two conducting wires separated and held by a central element, reinforcing filaments parallel to the said conductors, at least one layer of braiding covering these elements, and at least one external coating layer. In this cable, the central element is a continuous element made of a thermofusible material and having two longitudinal recesses arranged symmetrically relative to a solid central part; part of the periphery of the conducting wires arranged in the recesses is not covered by the thermofusible material, and the assembly consisting of the central element and the conducting wires has, transversely, a generally elliptical contour.

Subsequently, it was proposed to omit the external coating layer and to carry out a shrinking operation on the braiding, which is generally made of polyester. This operation, which is carried out by passage through an oven at a temperature of about 200° C. and at a speed of about 5 m/minute is intended slightly to reduce the diameter of the finished cable and to confine any excessively loose strands, which would hinder the unwinding of the cable. However, during this operation, the heat diffuses into the core of the cable, and the thermofusible material of the central element softens and "sweats" out of the element. This results in deformation of the central element and reduction and non-uniformity of the separation between the conducting wires, which, in places, can end up side by side. The transmission of the signals can thus be greatly distorted.

According to the present invention there is provided a remote control cable comprising a central element consisting of a textile element, two separate conducting wires in contact with the central element over their entire length and separated by the central element which keeps them parallel to one another, the diameter of the central element being slightly greater than the desired spacing between the wires, a coating of thermofusible material for the textile element and the two conducting wires, a bundle of reinforcing filaments surrounding the central element and conducting wires extending parallel thereto, and at least one layer of braiding covering the central element, the conducting wires, the coating and the reinforcing filaments.

Such a cable has improved characteristics compared with earlier cables, in particular as regards to the holding and separation of the conducting wires arranged in its central part.

The conducting wires are preferably enamelled copper wires, the diameter of which is advantageously between 0.06 and 0.10 mm and their separation is preferably between 0.03 and 0.06 mm.

The conducting wires and the central element form an assembly which will be designated as the "core" of the cable.

The textile element consists of a material of low or zero sensitivity to heat, from the point of view both of fibre degradation and of shrinkage. For example, it is possible to use an aromatic polyamide, such as that known under the tradename "KEVLAR", or silicone. The diameter of the textile element is preferably slightly greater than the desired separation between the conducting wires; thus, during the manufacture of the core, there is deformation of the textile element by compression, and the conducting wires become slightly embedded in the latter. The linear density of the textile element is advantageously between 100 and 300 dtex, according to the desired separation, the diameter of the conducting wires and the material of which the textile element is made. The coating material is preferably a homogeneous thermofusible material having a low dielectric constant, such as a mixture of waxes, paraffin and polyethylene of low molecular weight. The polyvinyl acetate/polyethylene copolymer designated by the name EVA is suitable. It can be used by itself or mixed with polyethylene. The core has a simple cross-section, for example approximately circular. Preferably, part of the periphery of the conductors is not covered by the coating, this uncovered part being less than half the periphery of the conductors.

The reinforcing filaments, which are placed parallel to the core, are preferably in the form of a parallel bundle arranged concentrically around the core so as to enclose it perfectly. Very strong filaments are used, such as those based on aromatic polyamide and known under the generic name "ARAMID".

The braiding advantageously consists of several superposed layers wound in opposite directions. It is preferred to use polyester filaments, which advantageously have thin strands so as to give a minimum bulk and a minimum weight.

According to another aspect of the present invention, there is provided a method of making a remote control cable, said method comprising the steps of:

(i) providing a calibrating die;

(ii) feeding a central textile element and two conducting wires towards said calibrating die so that the wires converge towards said central textile element;

(iii) passing the central textile element and the two conducting wires simultaneously through said die so that they pass parallel to its axis, with the conducting wires on either side of said central textile element, the wires being in rubbing contact with said die so that they are urged into and produce a deformation of said textile element and become slightly embedded therein;

(iv) applying a molten, thermofusible coating to the central textile element and the two conducting wires before they pass through the die;

(v) laying a bundle of reinforcing filaments so that they surround the central element and the conducting wires and extend parallel thereto; and (vi) applying at least one braiding around the thus formed assembly.

Advantageously, the relative dimensions of the die and of the assembly consisting of the textile element and the two conducting wires are such as to produce deformation of the textile element, the conducting wires becoming slightly embedded in the latter, during the passage through the die. Thus, if the cross-section of the orifice of the die is rounded, its diameter will have to be less than the sum of the diameters of the conducting wires and the central textile element. Likewise, if the cross-section of the orifice is rectangular, its length will be less than the sum of the diameters referred to above.

According to a first embodiment, the textile element and the two conducting wires pass through a bath of molten coating material immediately upstream of the die. The speed of passage through the bath and the die is preferably of the order of 5 to 20 m/minute, advantageously between 6 and 10 m/minute.

According to a second, preferred, embodiment, the molten coating material is deposited on the conducting wires and the textile element, only at the inlet of the die, by feeding in a flow of material. The speed of passage through the die is preferably at least 20 m/minute and advantageously between 20 and 100 m/minute. Because of this relatively high speed of passage, a bead of molten material forms at the inlet of the die. This bead facilitates the coating of the conducting wires and the textile elements and facilitates the cablibration.

The flow is calculated so as to have a minimum loss of material, taking the speed of passage into account. The flow rate is advantageously adjustable. It is of the order of 10 to 50 grams per kilometer for a core of which the constituents have the dimensions indicated above.

According to a preferred embodiment, the molten coating material is fed in under gravity from a melting pot located above the horizontally placed die. The melting pot is preferably heated by electrical means and is advantageously fitted with a temperature-regulating device. The flow takes place through a calibrated orifice and can be adjusted by means such as a valve.

Advantageously, the die is heated, either separately or by means which are common to the melting pot. The angle at which the conducting wires enter the die can vary. Advantageously, however, it has a value of about 60°. Irrespective of the method of carrying out the first step, the second step of the process at least consists in laying the parallel reinforcing filaments around the core and in carrying out the braiding continuously, in accordance with known techniques, for example of the type according to Addition No. 90,970to French Pat. No. 1,477,500.

Advantageously, the braiding is followed by a heat-shrinking operation carried out discontinuously. The purpose of this invention is to reduce the diameter of the finished cable and to confine any excessively loose strands capable of hindering the unwinding.

It is advantageously carried out by passage through an oven, the temperature of which is chosen as a function of the material of which the braiding filaments are made.

According to a still further aspect of the invention there is provided apparatus for use in a method of making a remote control cable, said apparatus comprising a calibrating die including a convergent wire guide inlet, means for guiding two conducting wires along separate paths converging towards said inlet, means for guiding a textile element along the axis of the die, pulling means arranged downstream of the die to draw the conducting wires and the textile element through said die to provide a finished core, consisting of the conducting wires slightly embedded in the textile element and means for feeding a molten, thermofusible coating material to the inlet of the die.

The axis of the die is preferably horizontal.

The means for guiding the conducting wires and the means for guiding the textile element consist of positioning guides accurately placed upstream of the die.

According to a first embodiment the means for feeding the molten coating material consist of a trough containing a bath of molten material, which is arranged upstream of the die adjacent to the latter. The positioning guides are arranged so as to define, for the conductors and the textile element, paths passing through the bath of material, the impregnation with molten material therefore taking place during the passage through the bath.

According to a second, preferred, embodiment, the means for feeding the molten material, in a simple manner, can consist of a melting pot arranged above the die and provided with a calibrated orifice through which the molten material escapes and flows under gravity up to the inlet face of the die. The melting pot is preferably heated by electrical means including a temperature-regulating system. The calibrated orifice can be provided with an adjusting valve so as to adjust the flow rate of molten material according to need, and in order to have a minimum loss. The die is advantageously provided with heating means, either separate from or common to the melting pot.

The pulling means arranged downstream of the die can consist of a take-up roller or of a device for direct winding at a constant linear speed. In all cases, it is provided with means for adjusting the speed as a function of the characteristics of the cable manufactured and the parameters of the process.

In order that the invention will be readily understood the following description is given with the aid of the example given below by way of illustration and without implying a limitation, reference being made to the accompanying drawings, in which:

FIG. 1 is a diagrammatic cross-section through the core of one embodiment of cable according to the invention;

FIG. 2 shows diagrammatically, in cross-section, the cable according to the application;

FIGS. 3 and 4 show diagrammatically, respectively in a front elevation and a top plan, a first embodiment of the apparatus according to the invention; and FIGS. 5 and 6 show diagrammatically, respectively in a front elevation and a top plan, a second embodiment of the apparatus according to the invention.

The cable core shown in FIG. 1 comprises two metal conductors 1 and 2, a textile element 3, arranged between the two conductors, and a coating 4. The two conductors 1 and 2 are slightly embedded in the textile element 3, which thus experiences deformation of its cross-section. The coating 4 covers the assembly comprising the conducting wires and the textile element, but leaves a free uncovered portion 5 on each of the conductors. The cross-section of the core produced in this way is approximately circular.

As seen in FIG. 2, which shows a finished cable, the core is surrounded by a bundle of reinforcing filaments 6, and by two layers of braiding 7 and 8 wound in opposite directions.

The apparatus illustrated diagrammatically in FIGS. 3 and 4 comprises a trough 15 containing a bath of molten coating material 9, a horizontal calibrating die 10, mounted at the outlet of the trough 15, and positioning guides 16. The die 10 has a conically widened inlet 17, the apex angle of the cone being about 60°. The positioning guides 16 define paths for the conducting wires 1 and 2 and for the textile element 3, which, starting from feed reels, which are not shown, pass through the bath 9 and become impregnated with coating material. The wires 1 and 2 pass through the trough 9 substantially parallel to one another, and then converge towards the die 10, forming an angle of about 60°. They pass through the die, rubbing against its walls, and the textile element is slightly compressed between them. The elements 1, 2 and 3 and the finished core are drawn by a pulling roller, shown schematically at 18, which is arranged downstream of the die 10. A sufficient distance is allowed between the die 10 and the pulling roller 18 for the cooling and hardening of the core in the atmosphere. The finished core is collected on a take-up spool after it is wrapped by the braiding filaments 6.

The device shown diagrammatically in FIGS. 5 and 6 is the preferred device for carrying out the process. It comprises a horizontal calibrating die 10 mounted in a die holder, not shown, and surmounted by a melting pot 11. The die has a conical inlet with an angle at the apex of about 60°. The melting pot 11 is heated electrically, for example by a Joule effect heater 11A, and therefore contains a bath of molten coating material 9. The latter flows under gravity through a calibrated orifice 12 which is substantially flush with the inlet face of the die 10. A valve 14 makes it possible to adjust the flow rate through the orifice 12 as a function of the parameters of the process. The die 10 is adjacent to the melting pot 11 and is heated by the same means as the said melting pot. Positioning guides 16 determine the paths of the elements 1, 2 and 3 up to the die 10. The conductors 1 and 2 enter the die at an angle of about 60° and pass through it, rubbing against its walls. The textile element 3 passes along the axis of the die and is advantageously slightly compressed between the conducting wires during its passage through the die. The elements 1, 2 and 3, together with the finished core, are drawn by a pulling roller 18, which is arranged downstream of the die 10 at a sufficient distance to permit the cooling and hardening of the coating material in the atmosphere.

The speed of the pulling roller, which is adjustable, is at least 20 m/minute and advantageously between 20 and 100 m/minute. This relatively high speed causes the formation of a bead 13 of material at the inlet of the die, the said bead assisting the coating and the calibration.

The core is collected on a take-up spool (not shown).

The embodiment of the device illustrated in FIGS. 5 and 6 has the advantage of easier threading of the conducting wires 1 and 2 and the textile element 3. In fact, it is possible to carry out the threading without the die being mounted, by choosing a location readily accessible by the operator, and subsequently only to mount the die in its holder.

EXAMPLE

A cable is produced according to the invention. The core is produced by the method illustrated in FIGS. 5 and 6 and the laying of the reinforcing filaments and the braiding are carried out in accordance with a process of the type described in Addition No. 90,970 to French Pat. No. 1,477,500, discontinuously with the manufacture of the core. The composition of the cable and the characteristics of the process are as follows:

a core consisting of 2 enamelled copper wires of diameter 0.07 mm and an aromatic polyamide filament of 220 dtex, the whole being kept calibrated by a thermofusible product, which is a mixture of EVA (60%) and polyethylene (40%). The calibration is carried out by passage through a die of diameter 0.24 mm, with a 60° conical inlet, at a speed of 50 m/minute. The core thus obtained has a substantial circular cross-section, the textile element being slightly compressed;

a reinforcement produced by 4 aromatic polyamide filaments of 220 dtex/134 strands; and two contiguous braidings wound in opposite directions and produced from polyester filaments (polyethylene glycol terephthalate) having a linear density of 50 dtex/44 strands, the braiding being carried out continuously with the positioning of the reinforcing filaments.

The cable manufactured in this way is subjected to a diameter-reducing operation by shrinking, which acts in particular on the braiding, by passage through an oven at about 200° C. and at a speed of about 5 ml minute.

During this operation, the central textile element undergoes neither degradation nor shrinkage; the two conductors in contact with this element remain perfectly in place. However, the thermofusible material is slightly softened and migrates into the reinforcing filaments to provide addition stability to the cable.

This gives a cable having the following characteristics:

final diameter=0.44 mm (diameter before shrinkage: 0.46 mm)
weight P=270 g/km
tensile strength R=18 daN
breaking coefficient R/P=72,000 m
Electrical characteristics:
resistance per conductor=4.7 ohms/m
capitance=80 pF/m With a cable of this type, it is possible to control a body moving at a speed of the order of 300 m/second and over a distance of the order of 4,000 m or more.

The cable according to the present invention is light, of small cross-section, of high tensile strength, virtually inextensible, flexible and leaktight. It has a good reliability in the transmission of signals, by virtue of the fact that the separation between the two conducting wires is substantially uniform over the entire length of the cable.

I claim:

1. A remote control cable suitable for controlling bodies moving at high speed comprising, in combination:

(a) a central element consisting of a textile element;
(b) two conducting wires in contact with the central element over their entire length and separated by the central element to maintain the conductors spaced apart a predetermined distance parallel to one another, the diameter of the central element being slightly greater than the predetermined distance between the wires;
(c) a thermofusible material coating the textile element and the two conducting wires;
(d) a bundle of reinforcing filaments surrounding the central element and conducting wires and extending parallel thereto; and
(e) at least one layer of braiding covering the central element, the conducting wires, the coating and the reinforcing filaments.

2. The cable as set forth in claim 1 wherein the textile element comprises an aromatic polyamide.

3. The cable as set forth in claim 1, wherein the textile element is comprised of silicone.

4. The cable as set forth in claim 1, 2 or 3 wherein the conducting wires have a diameter in the range of from about 0.06 to about 0.10 mm and are spaced apart, in parallel, by the central textile element a distance in the range of from about 0.03 to about 0.06 mm, said textile element having a linear density in the range of from about 100 to about 300 dtex.

5. The cable as set forth in claim 4 wherein the conducting wires are enamelled copper wires.

6. The cable as set forth in claim 5 wherein the conducting wires are slightly embedded in the periphery of the central textile element and the coating of thermofusible material covering the entire exposed periphery of the central textile element and at least more than half of the exposed periphery of each of the two conducting wires, whereby the combination of the central textile element, two conducting wires, and thermofusible coating form a core having a substantially circular cross-section.

7. The cable as set forth in claim 1 wherein the thermofusible material has a low dielectric constant and is selected from the group consisting of a homogeneous mixture of wax, paraffin and low molecular weight polyethylene, a copolymer of ethylene and vinyl acetate, and a mixture of said copolymer with polyethylene.

8. The cable as set forth in claim 1 wherein the thermofusible coating covers less than the entire periphery of the conducting wires, said uncovered portion being less than half the periphery of the conducting wires.

9. In a remote control cable capable of controlling bodies moving at high speed, for example at a speed of the order of 300 meters per second, wherein the cable includes a core formed from two conducting wires separated and held by a central element, a bundle of reinforcing filaments surrounding the core and extending parallel thereto, and at least one layer of braiding covering the core and the reinforcing filaments, the improvement wherein the core includes the central element consisting of a textile element and a thermofusible material coating the textile element and the two conducting wires and wherein the two conducting wires are slightly embedded in the periphery of the central textile element over their entire length whereby the conductors are separated by the central textile element and maintained spaced apart a predetermined distance parallel to one another, the diameter of the central element being slightly greater than the predetermined distance between the conducting wires, and wherein the coating of thermofusible material covers the entire exposed periphery of the central textile element and at least more than half of the exposed periphery of each of the two conducting wires, whereby the combination of the central textile element, two conducting wires and thermofusible coating form said core having a substantially circular cross-section.

10. The cable as set forth in claim 9 wherein the textile element comprises an aromatic polyamide.

11. The cable as set forth in claim 10 wherein the conducting wires have a diameter in the range of from about 0.06 to about 0.10 mm and are spaced apart, in parallel, by the central textile element a distance in the range of from about 0.03 to about 0.06 mm, said textile element having a linear density in the range of from about 100 to about 300 dtex.

12. The cable as set forth in claim 11 wherein the conducting wires are enamelled copper wires.

13. The cable as set forth in claim 9 or 10 wherein the thermofusible material has a low dielectric constant and is selected from the group consisting of a homogeneous mixture of wax, paraffin and low molecular weight polyethylene, a copolymer of ethylene and vinyl acetate, and a mixture of said copolymer with polyethylene.

14. The cable as set forth in claim 9 or 10 wherein the thermofusible coating covers less than the entire periphery of the conducting wires.

* * * * *

UNITED STATES PATENT AND TRADEMARK OFFICE

CERTIFICATE OF CORRECTION

PATENT NO. : 4,443,658

DATED : April 17, 1984

INVENTOR(S) : PIERRE SEGUIN

It is certified that error appears in the above-identified patent and that said Letters Patent is hereby corrected as shown below:

On the title page the following should be added:

-- [30] Foreign Application Priority Data

July 10, 1981 [FR] France.....81 13835 --.

Signed and Sealed this

Twenty-eighth Day of May 1985

[SEAL]

*Attest:*

DONALD J. QUIGG

*Attesting Officer* *Acting Commissioner of Patents and Trademarks*